US007671263B1

(12) United States Patent
Coady

(10) Patent No.: US 7,671,263 B1
(45) Date of Patent: Mar. 2, 2010

(54) LOCKING MECHANISM FOR PERCUSSION MUSICAL INSTRUMENT

(75) Inventor: William Joseph Coady, Port Hawkesbury (CA)

(73) Assignee: Billdidit Inc., Sydney, NS (CA)

( * ) Notice: Subject to any disclaimer, the term of this patent is extended or adjusted under 35 U.S.C. 154(b) by 0 days.

(21) Appl. No.: 12/428,830

(22) Filed: Apr. 23, 2009

(51) Int. Cl.
*G10D 13/02* (2006.01)

(52) U.S. Cl. ..... 84/422.3

(58) Field of Classification Search ..... 84/422.1, 84/422.2, 422.3, 421
See application file for complete search history.

(56) References Cited

U.S. PATENT DOCUMENTS 4,528,888 A 7/1985 Hoshino
4,667,562 A 5/1987 Lee
4,730,532 A 3/1988 Bauerfeind
4,928,567 A 5/1990 Kurosaki
5,028,776 A 7/1991 Forti et al.
5,438,903 A 8/1995 Cropek

*Primary Examiner*—Kimberly R Lockett
(74) *Attorney, Agent, or Firm*—Mark & Clerk; Richard J. Mitchell

(57) ABSTRACT

A high hat cymbal has a magnetic clutch that engages the top cymbal and allows it to be controlled by a standard high hat foot pedal. When the drummer's foot is removed from the high hat foot pedal, the magnetic clutch strikes a mechanical arm which causes the magnetic clutch to disengage without any action required on the part of the drummer. The top cymbal can be re-engaged by the magnetic clutch so that the high hat foot pedal can now be operated again, simply by depressing the high hat foot pedal. A trip bar may be provided to provide for automatic disengagement of the clutch mechanism.

32 Claims, 5 Drawing Sheets

LOCKING MECHANISM FOR PERCUSSION MUSICAL INSTRUMENT

FIELD OF THE INVENTION

This invention relates to the field of percussion instruments, such as high hat cymbals, and in particular to a locking mechanism for use in such instruments.

BACKGROUND OF THE INVENTION

Most bands playing popular modern music will include a drummer, playing a drum set, also called a drum kit. The drum kit typically consists of a bass drum, snare drum, tom toms, cymbals, and a high hat cymbal. Modern drumming techniques have evolved significantly since the advent of rock and roll music in the 1950's. Modern drummers have a wide variety of percussive instruments, as well as the typical kit components, and they arrange these different instruments to suit their particular tastes and styles.

A high hat cymbal actually consists of two cymbals facing each other. The high hat cymbal is struck by a drumstick, but is also operated using a foot pedal. The foot pedal operation consists of "closing and opening" the high hat, that is bringing the top cymbal into tight contact with the bottom cymbal to make a staccato sound, known as closing the high hat, or allowing the top cymbal to rise into looser contact with the bottom cymbal creating a ringing or less staccato sound, known as opening the high hat.

The drummer keeps the high hat in the closed position by depressing the foot pedal. Releasing the foot pedal allows a spring mechanism to raise the top cymbal into the open position. With a conventional high hat arrangement, the drummer must have a foot on the high hat foot pedal to operate the instrument. Also, to operate the high hat cymbal in the closed position, the drummer must still have one foot on the foot pedal. This "ties up" one foot and makes it impossible for the drummer to use that foot to operate other instruments.

The bass drum is struck by a mallet which is operated by a foot pedal. Modern drumming techniques, especially in rock genres such as hard rock, heavy metal, speed metal, etc., call for a technique that uses two bass drum pedals, commonly referred to as "double bass". Since the drummer only has two feet, he or she cannot operate two bass drum pedals and a high hat pedal simultaneously.

Since the desired default position for the high hat cymbal is the closed position, it is known to disengage the top cymbal from the central shaft that ties it to the foot pedal in order to drop into a closed position with the bottom cymbal. Ideally, disengaging the top cymbal and allowing it to fall into the closed position should be done with minimum distraction to the drummer. However, the top cymbal needs to be re-engaged so that the drummer can operate it using the high hat foot pedal, again, while minimizing distractions to the drummer. In summary, the top cymbal needs to be engaged and disengaged without interfering with the drummer's playing in any way.

Attempts have been made to solve this problem in the prior art, for example, as described in U.S. Pat. Nos. 4,667,562; 4,730,532; 4,928,567. These designs require action on the part of the drummer, leading to distraction, or are overly complex, see, for example, U.S. Pat. No. 5,028,776, or create additional clutter in the drummers playing area.

SUMMARY OF THE INVENTION

The invention addresses the problems arising in the prior art in one aspect by providing automatic disengagement of the upper cymbal as it returns to its raised position by operation of the spring mechanism associated with the foot pedal, and in another aspect by providing an advantageous locking mechanism that is reliable and less complex than the prior art.

Thus, in accordance with one aspect of the invention there is provided a locking mechanism for a musical percussion instrument comprising a pair of upper and lower cymbals, wherein the lower cymbal is fixedly mounted on a tubular support, and the upper cymbal can be raised or lowered by means of a foot-operated control rod extending within the tubular support and normally biased into the raised position, comprising an upper collar component mountable on said control rod and including a clamp for locking said upper collar component to the control rod; a lower collar component slidable on the control rod and configured for fixed attachment to the upper cymbal; and a clutch mechanism for engaging said lower collar component with said upper collar component upon contact whereby during engagement of said clutch mechanism said lower collar component moves up and down with said upper collar component during operation of the control rod; a protruding trip member operable upon actuation to disengage said clutch mechanism and thereby release said lower collar component from said upper collar component to allow said upper cymbal to fall onto said lower cymbal in unison with said upper collar component; and a trip bar mountable beside the percussion musical instrument to actuate the trip member when the upper cymbal is raised beyond a predetermined height.

The trip bar is preferably in the form of a generally C-shaped rod mountable on the tubular support itself. It will be understood that the expression generally C-shaped is intended to describe the configuration such that the trip bar is configured to be attached to the tubular support, extend outwardly around the cymbals, and contact the clutch mechanism to disengage the latter, preferably by actuating a trip flange or other release member.

In a second aspect the invention provides a locking mechanism for a musical percussion instrument comprising a pair of upper and lower cymbals, wherein the lower cymbal is fixedly mounted on a tubular support, and the upper cymbal can be raised or lowered by means of a foot-operated control rod extending within the tubular support and normally biased into the raised position, comprising: an upper collar component mountable on said control rod and including a clamp for locking a body portion of said upper collar component to the control rod; a lower collar component slidable on the control rod and configured for fixed attachment to the upper cymbal; and a clutch mechanism for engaging said lower collar component with said upper collar component upon contact whereby during engagement of said clutch mechanism said lower collar component moves up and down with said upper collar component during operation of the control rod; wherein said clutch mechanism includes respective upper and lower mating flanges on said upper and lower collar components and said engagement is ensured by magnetic coupling between said upper and lower mating flanges when said upper and lower mating flanges are in contact; wherein said upper mating flange is tiltable relative to the body portion of said upper collar component; and wherein said clutch mechanism includes a protruding trip member operable upon actuation to tilt said upper mating flange to at least partially separate said upper and lower mating flanges and thereby break said magnetic coupling and allow said upper cymbal to fall onto said lower cymbal in unison with said upper collar component.

This mechanism is well adapted for use with the trip bar, but it nevertheless offers advantages over the prior art in terms of reliability and simplicity. The tilting of the upper mating flange releases the magnetic engagement and allows the upper cymbal to fall onto the lower cymbal in the closed position, yet also ensures quick re-engagement of the clutch when the upper collar component is brought back down onto the lower collar component by operating the foot pedal. As soon as the mating flanges come into engagement, the clutch re-engages without the need for any movable locking members or the like.

The drummer can now strike the high hat cymbals in the closed position while working the second bass pedal, or other instrument. When he/she wishes to operate the high hat again, he/she simply depresses the foot pedal causing the vertical shaft and the second section to come down. The magnets from the second section will engage the steel flange from the first section, and now the top cymbal is connected to the vertical shaft, which is connected to the high hat foot pedal and the drummer is now in full control of the high hat.

A still further aspect of the invention provides a musical percussion instrument comprising a pair of upper and lower cymbals, wherein the lower cymbal is fixedly mounted on a tubular support, and the upper cymbal can be raised or lowered by means of a foot-operated control rod extending within the tubular support and normally biased into the raised position; an upper collar component mountable on said control rod and including a clamp locking said upper collar component to the control rod; a lower collar component slidable on the control rod and fixedly attached to the upper cymbal; and a clutch mechanism for engaging said lower collar component with said upper collar component upon contact whereby during engagement of said clutch mechanism said lower collar component moves up and down with said upper collar component during operation of the control rod; said clutch mechanism including a protruding trip member operable upon actuation to disengage said clutch mechanism and thereby release said lower collar component from said upper collar component to allow said upper cymbal to fall onto said lower cymbal in unison with said upper collar component; and a trip bar mounted beside the percussion musical instrument to actuate the trip member when the upper cymbal is raised beyond a predetermined height determined by the level of the trip bar.

BRIEF DESCRIPTION OF THE DRAWINGS

The invention will now be described in more detail, by way of example only, with reference to the accompanying drawings, in which.

DETAILED DESCRIPTION OF THE PREFERRED EMBODIMENTS

Figure 1A:
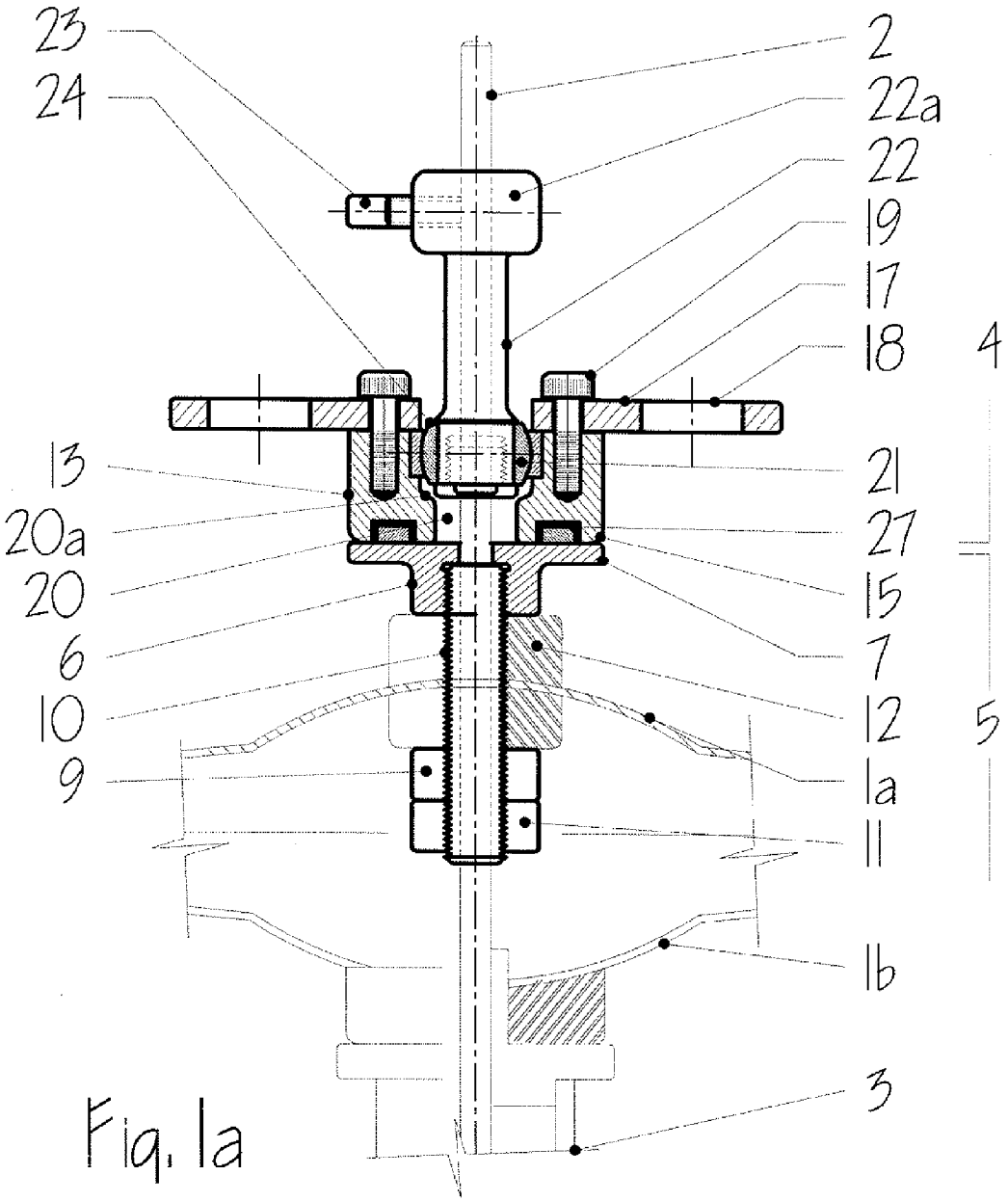
FIG. 1*a* is a cross section through a locking mechanism mounted on a high hat cymbal set in accordance with one embodiment of the invention.
Figure 1B:
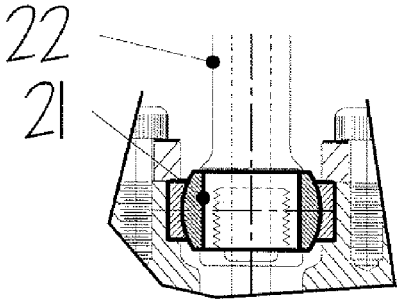
FIG. 1*b* shows a detail of FIG. 1*a;*

The locking mechanism shown in FIG. 1*a* comprises an upper cymbal 1*a* coupled to a control rod 2 and a lower cymbal 1*b* mounted on a tubular support 3 surrounding the control rod 2. The control rod 2 is moved up and down within the tubular support 3 by a foot-operated pedal 40 (FIGS. 5-7) and normally biased by a spring mechanism 41 into the raised position. Operation of the foot-pedal against the bias of the spring brings the upper cymbal 1*a*, when engaged with the control rod, down into contact with the lower cymbal 1*b* (the closed position). The operation of the control rod and foot pedal is not described in detail since it is conventional.

The locking mechanism comprises an upper collar component 4 locked to the control rod 2 and a lower collar component 5 attached to the upper cymbal 1*a*.

The lower collar component 5 comprises a mild steel mounting nut 6 with an upwardly facing lower mating flange 7 designed to be slidably fitted onto the control rod 2. In addition, the lower collar component 5 has a threaded bore 8 screwed onto a drilled threaded rod 9 also fitted over the control rod 2 and extending through central hole 10 formed in the upper cymbal 1*a*.

The lower collar component 5 is secured to the upper cymbal by means of nuts 11 screwed onto the lower portion of the drilled threaded rod 9 protruding below the lower cymbal 1*b*. A spacer 12 extending through the central hole 10 is sandwiched between the steel mounting nut 6 and nuts 11.

Figure 2:
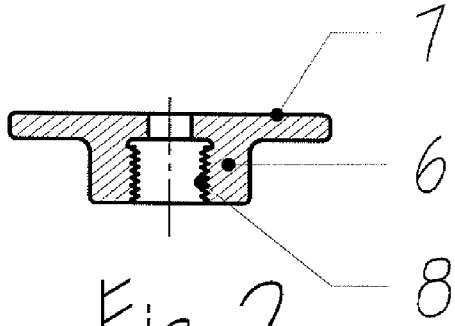
FIG. 2 is a cross section of the mounting nut.
Figure 3:
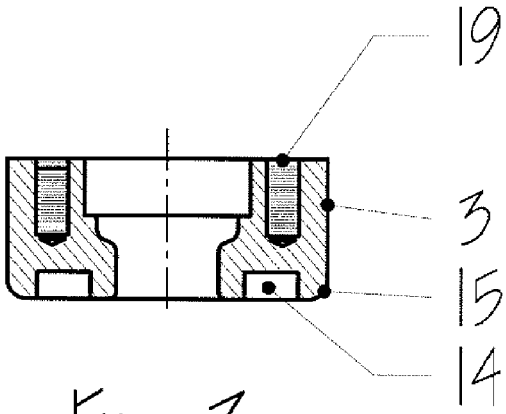
FIG. 3 is a detailed view of the magnet ring.

The upper collar component consists of an aluminum magnet ring 13 with a circular row of recesses 14 (FIG. 2) on its lower surface forming a lower mating flange 15. The recesses 14 accommodate permanent magnets 27, which advantageously may be permanent magnets, and preferably rare earth magnets, such that when the upper and lower mating flanges 15, 7 are brought into contact, magnetic attraction between the magnets and the steel lower flange keeps them together.

A plastic disc containing a circular array of holes 18 for lightness and providing the trip flange 17 is screwed onto the magnet ring 13 by means of screws 19 extending into threaded holes in the magnet ring.

The magnet ring 13 has a central bore 20 with an upper widened portion 20*a* accommodating outer cylindrical bearing 21, which is held in place in the widened portion 20*a* by the inner rim of the plastic disc 17 overlapping the wall of the widened portion 20*a* of the central bore of the magnet ring 13.

Figure 4:
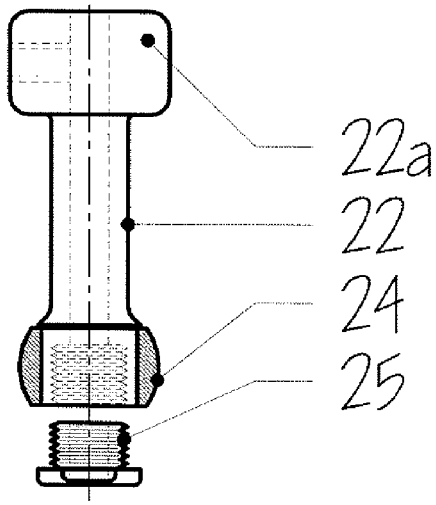
FIG. 4 is a detailed view of the upper mounting collar.

The upper collar component 4 also includes an aluminum mounting collar 22 (FIG. 4) through which passes the control rod 2. The mounting collar 22 is locked onto the control rod by means of locking bolt 23*a* extending into the head 22*a* of the mounting collar 22.

The lower end of the mounting collar 22 passes through a spherical steel bearing 24, which is held in place by a hollow nut 25 screwed into the end of the mounting collar 22. A suitable bearing is commercially available and goes by the designation GE 15 ES from AB SKF.

The outer bearing 21 and spherical bearing 24 form a ball joint that permits the upper collar component 4 to be tilted relative to the lower collar component 5. This tilting movement can be brought about by the drummer striking the plastic disc forming trip flange 17. When the magnet ring 13 is tilted in this way, at least some of the magnets 27 are separated from the lower mating flange 7. As a result, the magnetic attraction becomes insufficient to hold the lower collar component in place so the magnetic coupling is broken and the upper cymbal 1*a* falls onto the lower cymbal 1*b*, namely into the closed position.

After being struck by the drummer, the upper collar component 4 returns to its level equilibrium position and remains separated from the lower collar component 5 while the control rod remains biased into its upper position by the spring-actuator mechanism 41. When the drummer operates the foot pedal 40 to lower the control rod, and the upper mating flange comes into contact with the lower mating flange 7, the magnetic attraction once again becomes sufficient to pick up the upper cymbal 1*a*, which then becomes coupled to the control rod through the upper collar component 4. As a result, the upper cymbal 1*a* moves up and down with the control rod while the drummer operates the foot pedal.

This embodiment has advantages over the prior art mechanisms but as described so far still requires manual operation by the drummer.

Figure 5:
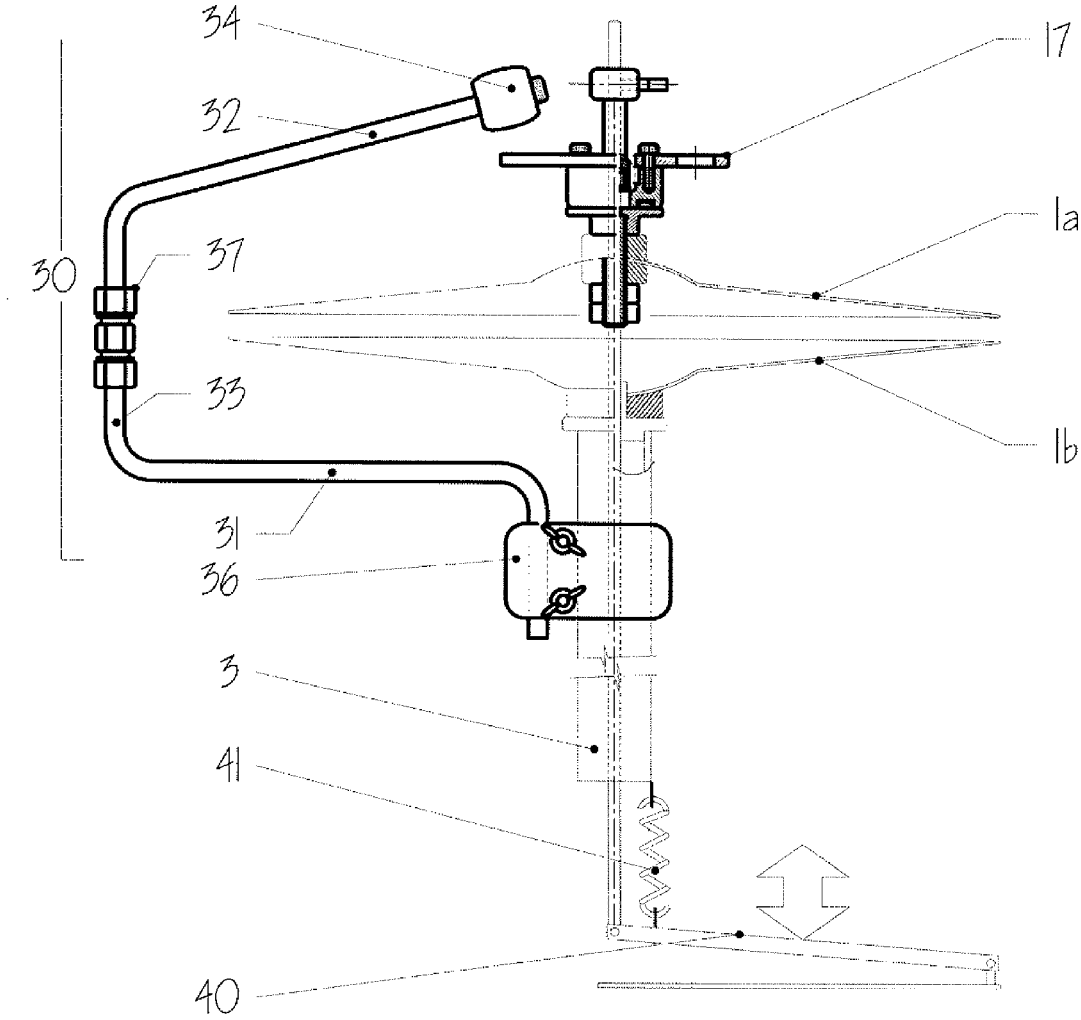
FIG. 5 is a side view of a complete high hat cymbal set with a locking mechanism in accordance with one embodiment of the invention, and wherein the cymbal set is in the normal playing position.
Figure 6:
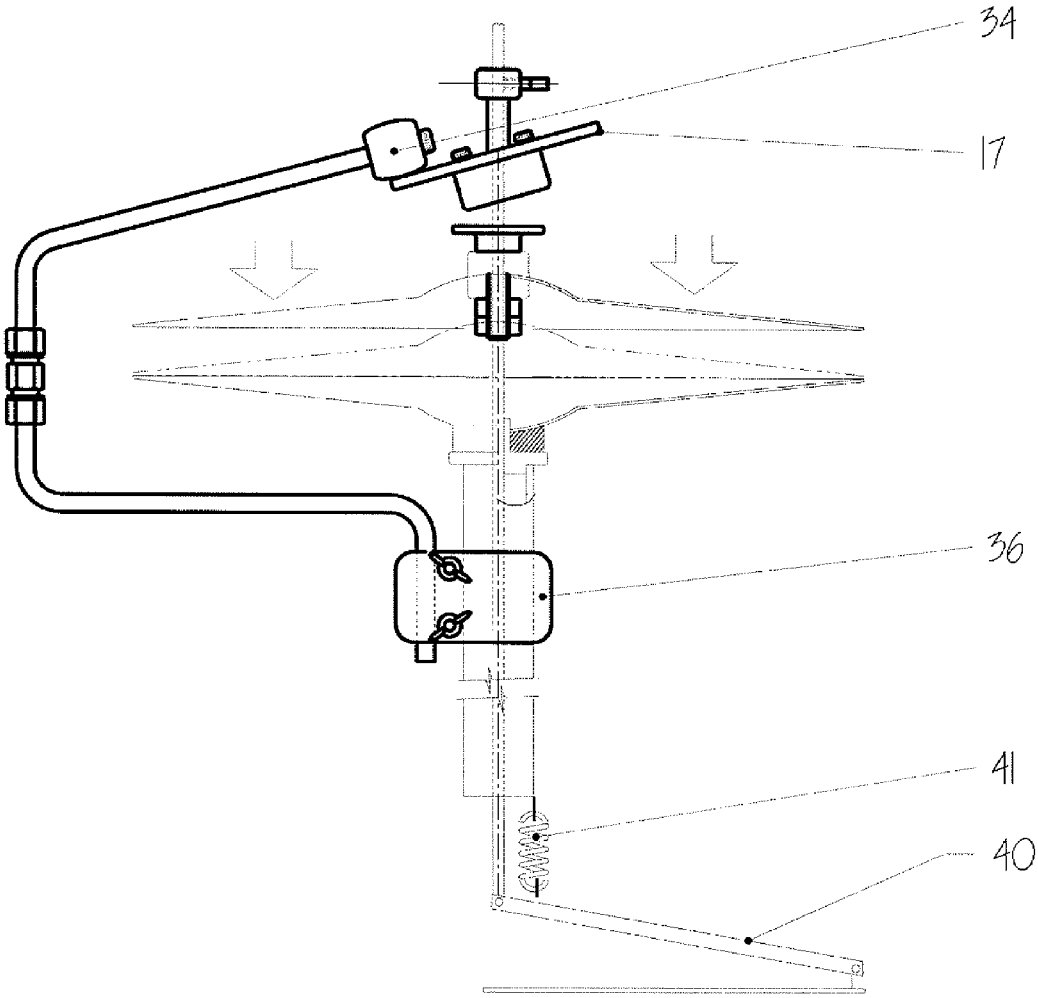
FIG. 6 is a view similar to the view in FIG. 5 showing the cymbal set during release of the upper cymbal.
Figure 7:
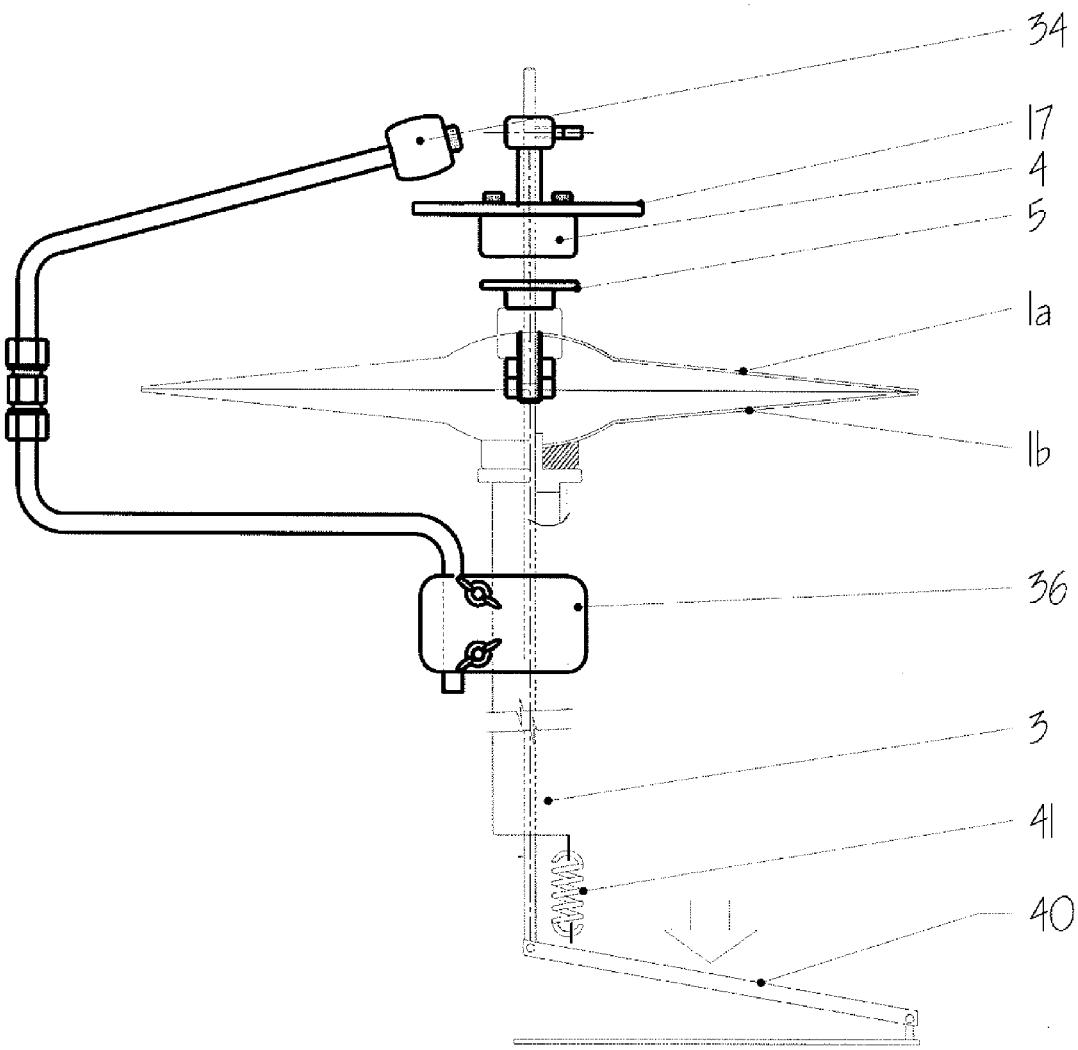
FIG. 7 shows the re-engagement of the upper cymbal with the control rod.

A further advantages feature is that a generally C-shaped mild steel trip bar 30, as shown in FIGS. 5 to 7, can be mounted on the tubular support 3 of the high hat cymbal set. The trip bar 30 has a pair of generally horizontal limbs 31, 32 extending at a slight angle to the horizontal and a vertical limb 33. The upper generally horizontal limb 32 terminates in a boss 34. A vertical lower limb 35 is attached to the tubular support below the lower cymbal 1*b* by means of a split collar clamped on the tubular shaft 3. Alternatively, the trip bar 30 can be mounted on a free standing support or to another part of the drum set, for example, the base drum. However, an advantage of mounting the trip bar 30 on the tubular support of the high hat cymbal set is that during a session a drummer may reposition the cymbal set, and when the trip bar is mounted on the tubular support, it will automatically move with the cymbal set. If it is mounted separately, the trip bar may move out of alignment with the cymbal set.

The vertical limb 33 includes a swivelable coupling 37 that allows the upper limb to be rotated about a vertical axis. This arrangement allows the drummer to move the boss out of the way when he or she desires to de-activate the automatic trip mechanism. However, even in this configuration with the trip bar swung out of the way, the drummer can still disengage the clutch mechanism manually by striking the trip flange 17, thereby allowing the upper cymbal 1*a* to fall into the closed position on the lower cymbal 1*b*.

In the operational position, the trip bar 30 is arranged so that the upper limb 32 extends over the rim of the trip flange 17 as shown in FIG. 7. When the trip flange 17 reaches a predetermined height (normally when the control rod 2 is in the fully raised position as shown in FIG. 6), the trip flange 17 catches the boss 34 of the trip bar 30, thus causing the upper collar component to tilt as if struck by the drummer. This action releases the upper cymbal 1*a*, allowing it to fall into the closed position on the lower cymbal 1*b*. The drummer is spared from the need to manually actuate the trip flange, allowing him or her to concentrate on other aspects of drumming.

FIG. 7 shows what happens when the drummer depresses the foot pedal to lower the control rod 2. The upper collar component 4 moves downwardly until the flange 15 contacts the flange 7, whereupon the magnetic attraction engages the upper and lower collar components so that as the drummer partially raises the foot pedal the upper cymbal 1*a* moves up and down with the control rod 2 until the trip flange 17 once again strikes the overhanging boss 14 when the control rod 2 reaches its upper position. If in the meantime the drummer swivels the boss 34 out of the way of the trip flange 17, the upper cymbal can reach its uppermost position while remaining engaged with the control rod. In this configuration, the drummer can strike the upper cymbal 1*a* in the free mounted mode.

The trip bar can be made adjustable in height, for example, by sliding the mounting collar 36 up and down the support shaft and clamping it at different positions to accommodate drummer preference as to the spacing between the upper and lower cymbals. It can also be made adjustable in lateral extent to accommodate different widths of cymbals.

While the trip bar 30 works is particularly well suited for use with the described embodiment, it will be appreciated that the trip bar can also be use to advantage with other forms of trip mechanism, such as the hook mechanism described in U.S. Pat. No. 4,928,567.

The magnets 27 are retained in the recesses by protruding threaded bolts inserted into threaded bores in the magnet ring 13. The number and strength of the magnets can be varied in order to accommodate different cymbal weights. Also, of course the magnets could be placed in the lower collar component, or alternatively in both collar components.

In the embodiment described, the lower mounting nut is made of ferromagnetic material, namely mild steel, in order to ensure a magnetic coupling with the permanent magnets 14. It will be appreciated that the configuration could be reversed so that the magnets were accommodated in the lower flange, or alternately, both flanges could be made of non magnetic material, such as aluminum, in which case it would be necessary to provide magnets in both flanges, or at least magnets in one flange and blocks of magnetic material in the other.

The description and drawings merely illustrate the principles of the invention. It will thus be appreciated that those skilled in the art will be able to devise various arrangements that, although not explicitly described or shown herein, embody the principles of the invention and are included within its spirit and scope. Furthermore, all examples recited herein are principally intended expressly to be only for pedagogical purposes to aid the reader in understanding the principles of the invention and the concepts contributed by the inventor(s) to furthering the art, and are to be construed as being without limitation to such specifically recited examples and conditions. Moreover, all statements herein reciting principles, aspects, and embodiments of the invention, as well as specific examples thereof, are intended to encompass equivalents thereof.

The invention claimed is:

1. A locking mechanism for a musical percussion instrument comprising a pair of upper and lower cymbals, wherein the lower cymbal is fixedly mounted on a tubular support, and the upper cymbal can be raised or lowered by means of a foot-operated control rod extending within the tubular support and normally biased into the raised position, comprising:

an upper collar component mountable on said control rod and including a clamp for locking said upper collar component to the control rod;

a lower collar component slidable on the control rod and configured for fixed attachment to the upper cymbal; and a clutch mechanism for engaging said lower collar component with said upper collar component upon contact whereby during engagement of said clutch mechanism said lower collar component moves up and down with said upper collar component during operation of the control rod;

a protruding trip member operable upon actuation to disengage said clutch mechanism and thereby release said lower collar component from said upper collar component to allow said upper cymbal to fall onto said lower cymbal in unison with said upper collar component; and a trip bar mountable beside the percussion musical instrument to actuate the trip member when the upper cymbal is raised beyond a predetermined height.

2. A locking mechanism as claimed in claim 1, wherein the trip bar is configured for fixed mounting on the tubular support.

3. A locking mechanism as claimed in claim 2, wherein the trip bar is generally C-shaped with an upper limb configured to overhang the cymbals and actuate the trip member when the upper cymbal is raised beyond said predetermined height, and a lower limb configured for attachment to the tubular support.

4. A locking mechanism as claimed in claim 3, wherein the trip bar includes a swivel mount to permit the upper limb to be swivelled out of the way when not required to actuate the trip member.

5. A locking mechanism for a musical percussion instrument comprising a pair of upper and lower cymbals, wherein the lower cymbal is fixedly mounted on a tubular support, and the upper cymbal can be raised or lowered by means of a foot-operated control rod extending within the tubular support and normally biased into the raised position, comprising:

an upper collar component mountable on said control rod and including a clamp for locking a body portion of said upper collar component to the control rod;

a lower collar component slidable on the control rod and configured for fixed attachment to the upper cymbal; and a clutch mechanism for engaging said lower collar component with said upper collar component upon contact whereby during engagement of said clutch mechanism said lower collar component moves up and down with said upper collar component during operation of the control rod;

wherein said clutch mechanism includes respective upper and lower mating flanges on said upper and lower collar components and said engagement is ensured by magnetic coupling between said upper and lower mating flanges when said upper and lower mating flanges are in contact;

wherein said upper mating flange is tiltable relative to the body portion of said upper collar component; and wherein said clutch mechanism includes a protruding trip member operable upon actuation to tilt said upper mating flange to at least partially separate said upper and lower mating flanges and thereby break said magnetic coupling and allow said upper cymbal to fall onto said lower cymbal in unison with said upper collar component.

6. A locking mechanism as claimed in claim 5, further comprising at least one permanent magnet located in at least one of said upper and lower mating flanges to provide said magnetic coupling with the other mating flange.

7. A locking mechanism as claimed in claim 6, wherein said at least one permanent magnet is a rare earth magnet.

8. A locking mechanism as claimed in claim 6, wherein the number of said permanent magnets is configurable to permit the clutch mechanism to be adapted to the weight of the upper cymbal.

9. A locking mechanism as claimed in claim 8, wherein said upper mating flange is pivotally mounted on said body portion by means of a ball joint.

10. A locking mechanism as claimed in claim 5, wherein said trip member is in the form of a trip flange for overhanging the upper cymbal.

11. A locking mechanism as claimed in claim 6, wherein the upper mating flange comprises a lower part for housing at least one magnet and an upper part incorporating the trip member, the upper part being clampable to the lower part.

12. A locking mechanism as claimed in claim 11, wherein the lower part of the upper mating flange is made of aluminum.

13. A locking mechanism as claimed in claim 12, wherein the lower mating flange is made of steel.

14. A locking mechanism as claimed in claim 5, further comprising a trip bar mountable beside the percussion musical instrument to actuate the trip member when the upper cymbal is raised beyond a predetermined height.

15. A locking mechanism as claimed in claim 14, wherein the trip bar includes a swivel mount so that it can be swivelled out of way when not required to actuate the trip member.

16. A locking mechanism as claimed in claim 14, wherein the trip bar is configured for fixed mounting on the tubular support.

17. A locking mechanism as claimed in claim 14, wherein the trip bar is generally C-shaped with an upper limb configured to overhang the cymbals and actuate the trip member when the upper cymbal is raised beyond said predetermined height, and a lower limb configured for attachment to the tubular support.

18. A locking mechanism as claimed in claim 16, wherein the upper limb is swivel mounted in relation to the lower limb to permit the upper limb to be swivelled out of the way when not required to actuate the trip member.

19. A musical percussion instrument comprising:

a pair of upper and lower cymbals, wherein the lower cymbal is fixedly mounted on a tubular support, and the upper cymbal can be raised or lowered by means of a foot-operated control rod extending within the tubular support and normally biased into the raised position;

an upper collar component mountable on said control rod and including a clamp locking said upper collar component to the control rod;

a lower collar component slidable on the control rod and fixedly attached to the upper cymbal; and a clutch mechanism for engaging said lower collar component with said upper collar component upon contact whereby during engagement of said clutch mechanism said lower collar component moves up and down with said upper collar component during operation of the control rod;

said clutch mechanism including a protruding trip member operable upon actuation to disengage said clutch mechanism and thereby release said lower collar component from said upper collar component to allow said upper cymbal to fall onto said lower cymbal in unison with said upper collar component; and a trip bar mounted beside the percussion musical instrument to actuate the trip member when the upper cymbal is raised beyond a predetermined height determined by the level of the trip bar.

20. A locking mechanism as claimed in claim 19, wherein the trip bar is fixedly mounted on the tubular support.

21. A locking mechanism as claimed in claim 20, wherein the trip bar is generally C-shaped with an upper limb configured to overhang the cymbals and actuate the trip member when the upper cymbal is raised beyond said predetermined height, and a lower limb attached to the tubular support.

22. A locking mechanism as claimed in claim 21, wherein the trip bar includes a swivel mount to permit the upper limb to be swivelled out of the way when not required to actuate the trip member.

23. A musical percussion instrument as claimed in claim 21, wherein said upper and lower collar components include respective upper and lower mating flanges, and said engagement is ensured by magnetic attraction when said upper and lower mating flanges are in contact.

24. A musical percussion instrument as claimed in claim 23, further comprising at least one permanent magnet located in at least one of said upper and lower mating flanges.

25. A musical percussion instrument as claimed in claim 24, wherein said at least one permanent magnet is a rare earth magnet.

26. A musical percussion instrument as claimed in claim 24, wherein the number of said magnets is configurable to permit the mechanism to be adapted to the weight of the upper cymbal.

27. A musical percussion instrument as claimed in claim 24, wherein said upper mating flange is pivotally mounted on a body portion of said upper collar component clamped to said control rod, and said trip member is connected to said upper mating flange whereby actuation of said trip member pivots said upper mating flange away from said lower mating flange to break magnetic coupling of said upper mating flange with said lower mating flange.

28. A musical percussion instrument as claimed in claim 27, wherein said upper mating flange is pivotally mounted on said body portion by means of a ball joint.

29. A musical percussion instrument as claimed in claim 23, wherein said trip member is in the form of a trip flange overhanging the upper cymbal.

30. A musical percussion instrument as claimed in claim 27, wherein the upper mating flange comprises a lower body for housing at least one magnet and an upper body incorporating the trip member, the upper body being clamped to the lower body.

31. A musical percussion instrument as claimed in claim 30, wherein the lower body is made of aluminum.

32. A musical percussion instrument as claimed in claim 31, wherein the lower mating flange is made of steel.

* * * * *